US008935980B2

(12) United States Patent
Ruhm et al.

(10) Patent No.: US 8,935,980 B2
(45) Date of Patent: Jan. 20, 2015

(54) SYSTEMS AND METHODS OF PRINTING TO A WEB SUBSTRATE

(75) Inventors: Benji Ruhm, Tel Aviv (IL); Zvika Yogev, Gedera (IL); Eyal Peleg, Zoran (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 303 days.

(21) Appl. No.: 12/918,305

(22) PCT Filed: Feb. 29, 2008

(86) PCT No.: PCT/US2008/055523

§ 371 (c)(1),
(2), (4) Date: Aug. 18, 2010

(87) PCT Pub. No.: WO2009/108204

PCT Pub. Date: Sep. 3, 2009

(65) Prior Publication Data

US 2010/0329765 A1 Dec. 30, 2010

(51) Int. Cl.

| | |
|---|---|
| ***B41F 13/24*** | (2006.01) |
| ***B41F 13/00*** | (2006.01) |
| ***B41F 5/04*** | (2006.01) |
| ***B65H 20/30*** | (2006.01) |
| ***G03G 15/00*** | (2006.01) |
| ***B41F 13/02*** | (2006.01) |

(52) U.S. Cl.

CPC ..... *G03G 15/652* (2013.01); *B41F 13/025* (2013.01); *G03G 2215/00021* (2013.01); *G03G 2215/00455* (2013.01)

USPC ..... 101/222; 101/232; 226/118.2

(58) Field of Classification Search

CPC ..... B41F 13/02; B41F 13/04; B65H 20/34; B65H 20/24; B65H 23/042; B65H 23/1888; B65H 2511/115; B65H 23/16

USPC ..... 101/219, 232, 484, 220, 222, 228; 226/118.2, 44, 118.3

See application file for complete search history.

(56) References Cited

U.S. PATENT DOCUMENTS 4,541,335 A * 9/1985 Tokuno et al. ..... 101/181
4,967,222 A * 10/1990 Nitsch ..... 396/616

(Continued)

FOREIGN PATENT DOCUMENTS

JP 2004001972 A 5/2002

OTHER PUBLICATIONS

International Searching Authority, ISA 220 ISR & Written Opinion, Nov. 26, 2008, 10 pages, Korean Intellectual Property Office, Republic of Korea.

(Continued)

*Primary Examiner* — Matthew G Marini
*Assistant Examiner* — Leo T Hinze
(74) *Attorney, Agent, or Firm* — Rader, Fishman & Grauer PLLC; Steven Nichols

(57) ABSTRACT

A printing device (100,101) has a first print engine (103, 303, 603, 703), a second print engine (105, 305, 605, 705), and a buffer device (107, 307, 609, 709, 711) disposed between the first (103, 303, 603, 703) and second print engines (105, 305, 605, 705). The buffer (107, 307, 609, 709, 711) is configured to store a variable amount of web substrate (106, 301, 713) received from the first print engine (103, 303, 603, 703) and feed the substrate (106, 301, 713) to the second print engine (105, 305, 605, 705).

25 Claims, 8 Drawing Sheets

(56) References Cited

U.S. PATENT DOCUMENTS

| | | | | |
|---|---|---|---|---|
| 5,548,390 | A | 8/1996 | Sugisaki | |
| 5,711,225 | A * | 1/1998 | Rasmussen | 101/483 |
| 5,713,071 | A | 1/1998 | Hausmann | |
| 5,765,481 | A * | 6/1998 | Tortora et al. | 101/211 |
| 5,860,053 | A | 1/1999 | Stemmle | |
| 6,476,410 | B2 * | 11/2002 | Ishinaga | 257/13 |
| 6,499,397 | B2 * | 12/2002 | Stern | 101/248 |
| 6,763,220 | B2 | 7/2004 | Nakazawa | |
| 7,245,856 | B2 | 7/2007 | Furst et al. | |
| 7,389,973 | B1 * | 6/2008 | Chou et al. | 254/277 |
| 7,739,952 | B2 * | 6/2010 | Sakamoto | 101/484 |
| 7,865,125 | B2 * | 1/2011 | Moore | 399/384 |
| 2005/0156005 | A1 * | 7/2005 | Coufal | 226/44 |
| 2007/0041049 | A1 | 2/2007 | Kojima | |

OTHER PUBLICATIONS

Japanese Patent Office Website Machine Translation of JP 2004001972A.

Examination Report Under Section 18(3), for App. No, GB1016360.8, May 30, 2012.

* cited by examiner

SYSTEMS AND METHODS OF PRINTING TO A WEB SUBSTRATE

BACKGROUND

Web presses are often used in large-scale printing operations. In typical web press devices, a continuous roll, or "web," of substrate (e.g. paper) is continuously fed through a print engine in the press. As the substrate is fed through the print engine, one or more colorants may be applied to the substrate by the print engine to form desired text and/or images on the substrate. The use of a web of substrate generally provides the advantage of enabling the press to feed the substrate through the print engine without having to individually feed separate sheets of paper, thus saving time and simplifying substrate loading procedures. After an image has been printed on the substrate, the printed portion of the substrate may be cut according to desired dimensions.

In some cases, web presses may include two or more printing engines operating in tandem to achieve increased productivity. For example, "dual" web presses typically combine two print engines such that the two print engines print on opposite sides of the substrate. However, these devices require synchronization between the print engines as the substrate advances in order to simultaneously print the correct images on both sides of the substrate while maintaining a specified document print order and alignment between images printed on both sides of the substrate. Accordingly, a great deal of development effort has been made to achieve this level of hardware and software synchronization between the print engines.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1A:
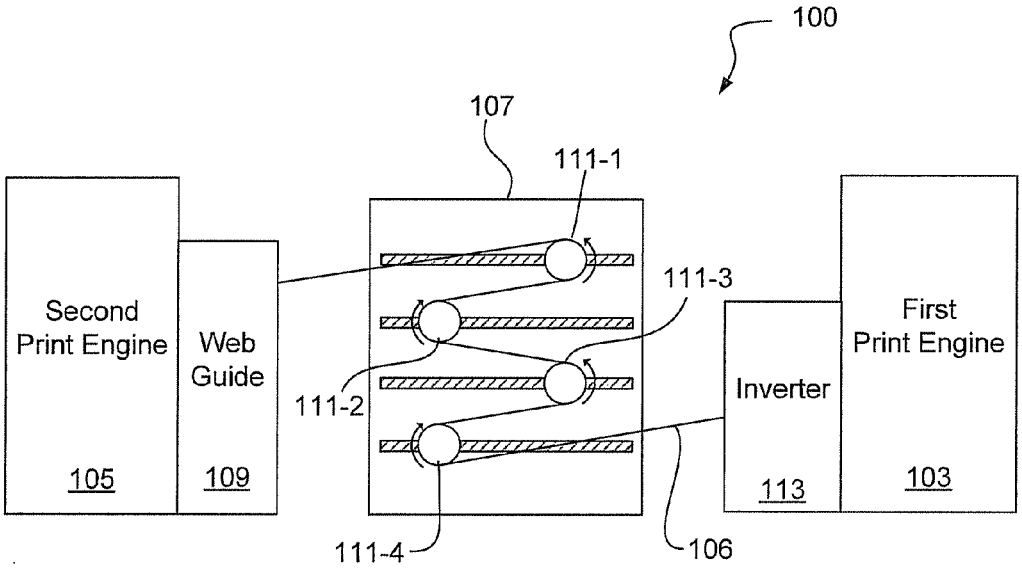
FIGS. 1A-1B are diagrams of illustrative printing devices for printing to a web substrate according to one embodiment of the principles described herein.

As described above, in some cases two or more print engines may be configured to operate in tandem to print on a common web substrate. However, many prior solutions require the web substrate to be synchronously fed through the print engines due to the continuous nature of the web substrate.

Forcing separate print engines to advance a substrate synchronously may reduce efficiency and necessitate a great deal of effort to adequately synchronize print operations in the print engines. It may be desirable, therefore, to provide a printing press or device having two or more tandem print engines printing to a common web substrate, but configured to operate substantially independently of each other and without requiring the web substrate to be fed through the print engines synchronously. Under this configuration, modularity of print engines may be enabled, such that the same print engines used in single-engine printing devices may be used in the tandem printing devices of the present specification with few or no changes to the print engines and little or no direct communication between the print engines.

The present specification discloses illustrative systems and methods of printing to a web substrate in which a buffer device is disposed between first and second print engines. The buffer device may be configured to store a variable amount of web substrate received from the first print engine and feed the substrate to the second print engine as needed. The buffer device may allow each print engine to perform print operations to the web substrate irrespective of a speed or print phase of the other print engine.

As used in the present specification and in the appended claims, the term "print engine" refers to a subsystem of interrelated components that is configured to selectively reproduce images and/or text on a substrate. A print engine may produce desired hardcopy using any of a wide variety of printing techniques.

As used in the present specification and in the appended claims, the term "web substrate" refers to a continuous sheet of a substrate, such as paper, that is stored on a reel and provided to a printing device by unrolling the reel.

In the following description, for purposes of explanation, numerous specific details are set forth in order to provide a thorough understanding of the present systems and methods. It will be apparent, however, to one skilled in the art that the present systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

The principles disclosed herein will now be discussed with respect to exemplary systems and methods for printing to a web substrate.

Illustrative Systems

Figure 1B:
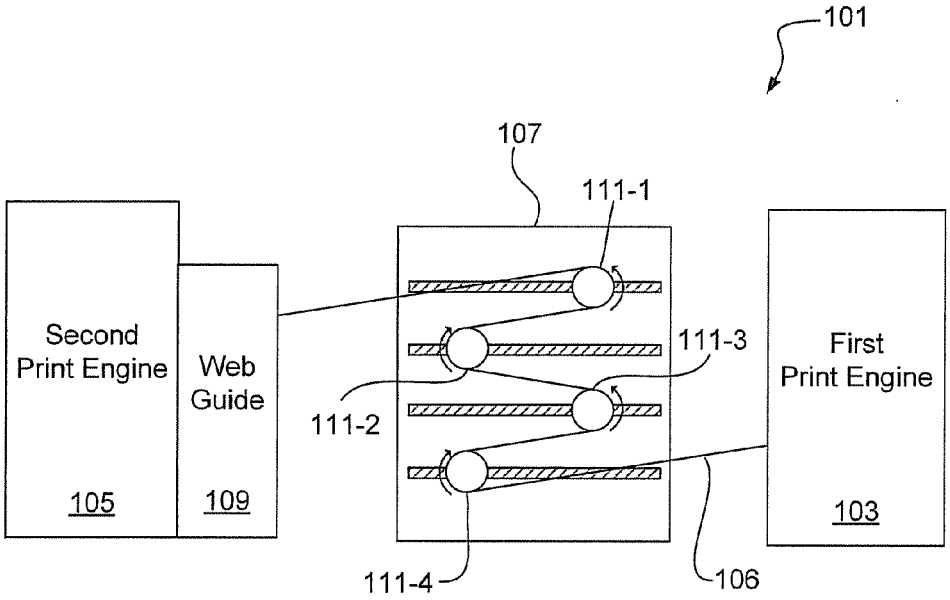

Referring now to FIGS. 1A-1B, illustrative printing devices (100, 101) are shown. Each of the illustrative printing devices (100) includes a first print engine (103) and a second print engine (105). The first and second print engines (103, 105) may be configured to print to a common web substrate (106). The first print engine (103) may be configured to print to the web substrate (106) before the second print engine (105) receives and prints to the web substrate (106).

It will be understood that the first and second print engines (103, 105) may include any suitable web-fed print engines (103, 105) in any suitable configuration, as may fit a particular application of the principles described herein. For example, the first and second print engines (103, 105) may include, but are not limited to, at least one or more of: digital press printing components, offset printing components, laser printing components, inkjet printing components, movable type printing components, combinations thereof, and the like.

It will also be understood that the web substrate (106) may include any suitable reeled substrate material, in any suitable configuration, as may fit a particular application of the principles described herein. For example, the web substrate may include, but is not limited to, at least one or more materials such as: common paper, coated paper, film, cloth, plastic, metal, wood and the like.

Each of the first and second print engines (103, 105) may be configured to concurrently print to separate portions of the web substrate (106) irrespective of a speed or print phase of the other of the first and second print engines. Thus, the print operations of the first and second print engines (103, 105) may be substantially independent of each other.

As a result of this independence, the first print engine (103) at times may output more or less of the web substrate (106) than is fed in to the second print engine (105) as disparate print operations are performed by the print engines (103, 105). To accommodate for the continuously variable amount of web substrate (106) that may be positioned intermediate the first and second print engines (103, 105), a buffer device (107) and a web guide (109) may be disposed between the first and second print engines (103, 105).

The buffer device (107) may be configured to store a variable amount of the web substrate (106) received from the first print engine (103) and to feed the stored web substrate (106) at a desired rate to the second print engine (105). The buffer device (107) may include a plurality of rollers (111-1 to 111-4, collectively "the rollers (111)") configured to house and transport the web substrate (106). The web substrate (106) may wrap around portions of the outer circumferential surfaces of the rollers (111) such that the rollers (111) rotate as the web substrate (106) is fed through the buffer device (107).

The web guide (109) may be configured to guide the web substrate (106) from an output of the buffer device (107) to an input of the second print engine (105). In certain embodiments, the web guide (109) may include powered rollers.

In some examples, the first print engine (103) may be configured to print to a first side of the web substrate (106) and the second print engine (105) may be configured to print to a second side of the web substrate (106). As shown in FIG. 1A, an inverter (113) may be included in the printing device (100) in such cases. The inverter (113) may function to flip the web substrate (106) into an optimal orientation for the second print engine to print to the substrate's second side. For example, if the print engines (103, 105) are configured to print to an upward facing side of the web substrate (106), the web substrate (106) may be loaded into the first print engine (103) with the first side facing upward. After print operations are performed on the first side of the web substrate (106) by the first print engine (103), the inverter (113) may flip the web substrate (106) such that the second side of the web substrate (106) is facing upward as the web substrate (106) is loaded into the second print engine (105).

In certain embodiments, the inverter (113) may include at least one turn bar, or any other suitable apparatus according to a particular application. Additionally, in some embodiments, the inverter (113) may be included or incorporated in the buffer device (107).

FIG. 1B shows an embodiment of a printing device (101) without the inverter (113). In certain examples, both the first print engine (103) and the second print engine (105) may be configured to print to the same side of the web substrate (106), in which case it may not be necessary to include an inverter (113) in the printing device (101). For example, the first print engine (103) may be configured to print black ink onto the web substrate (106) and the second print engine (105) may be configured to print colored ink onto the same side of the web substrate (106) used by the first print engine (103). In still other examples, both print engines (103, 105) may be configured to print four colors to the web substrate (106), with the first print engine (103) leaving gaps between images printed on the web substrate (106) to which the second print engine (105) prints, thus increasing productivity in some printing applications.

Due to the first and second print engines (103, 105) being configured to perform print operations substantially independent of each other, the first print engine (103) may output the web substrate (106) to the buffer device (107) at different rates and times than those at which the second print engine (105) is configured to receive the web substrate (106). Thus, the amount of web substrate (106) housed in the buffer device (107) may change dynamically during printing operations.

The rollers (111) may be configured to maintain the dynamic amounts of the web substrate (106) at a substantially constant tension. Under this tension, friction between the outer circumferential surfaces of the rollers (111) may help to enable smooth feeding of the web substrate (106) from the first print engine (103) through the buffer device (107) and into the second print engine (105) and to avoid jams.

Figure 2A:
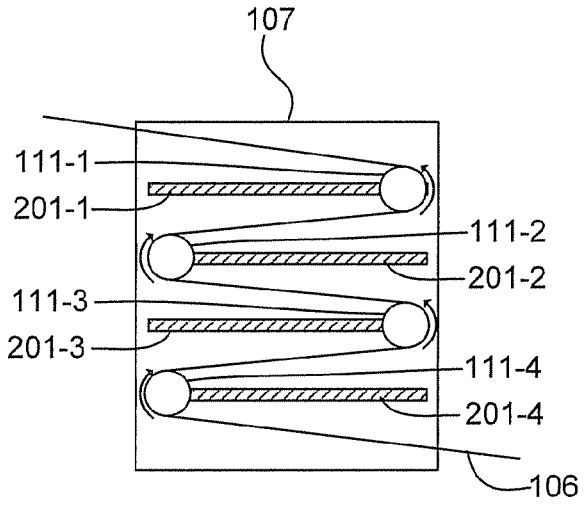
FIGS. 2A-2C are diagrams of illustrative configurations of an illustrative buffer device according to one embodiment of the principles described herein.
Figure 2B:
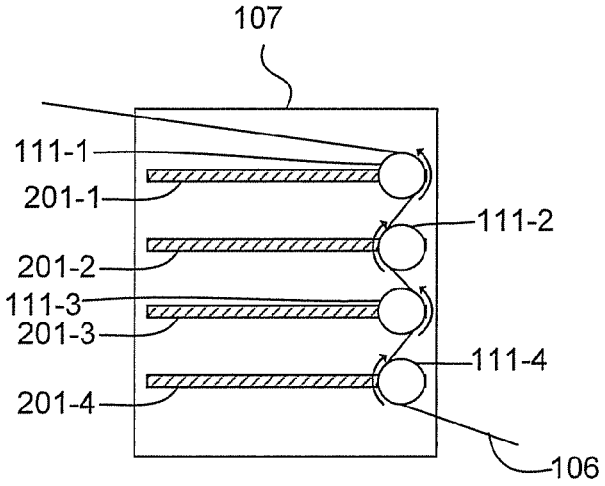
Figure 2C:
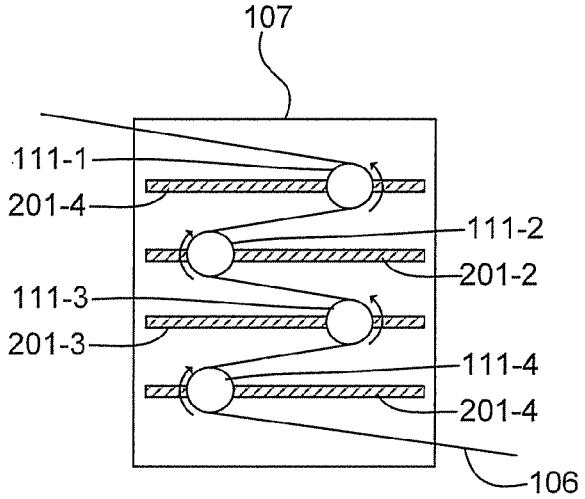

Referring now to FIGS. 2A-2C, the illustrative buffer device (107) described above is shown with the rollers (111) in various positions. In certain embodiments, one or more of the rollers (111) may be configured to selectively move along predefined axes (201-1 to 201-4) to accommodate the need for more or less of the substrate (106) to be stored in the buffer device (107).

Thus, when the average distance between adjacent rollers (111) is at a maximum, as shown in FIG. 2A, the buffer device (107) may be operating at full capacity and not able to store any more of the web substrate (106) at the desired tension. Similarly, when the average distance between adjacent rollers (111) is at a minimum, as shown in FIG. 2B, the buffer device (107) may be operating at a minimum capacity, and unable to provide more of the web substrate (106) to the second print engine (105) without damaging the web substrate (106) or causing problems to the print engines (103, 105) or the buffer device (107). Under normal operations, the buffer device (107) may have the rollers (111) positioned in intermediate states, such as that shown in FIG. 2C, according to the dynamic storage needs of the buffer device (107).

In certain embodiments, the buffer device (107) may include at least one actuator configured to position the rollers (111) according to the amount of substrate (106) to be stored by the buffer device (107) and the desired tension of the substrate (106). For example, the actuator may include, but is not limited to one or more of: a hydraulic piston, a pneumatic piston, an electric motor, a gear, a drive belt, a drive chain, a lever, and any other suitable component for positioning the rollers (111) as may fit a particular application of the principles described herein.

To maintain the desired tension on the substrate (106), feedback may be obtained by control circuitry in the buffer device (107) from the print engines (103, 105, FIG. 1) regarding the rate or amount of substrate (106) that is being added to or removed from the buffer device (107). The control circuitry may then calculate a new position of the rollers (111) to maintain the desired tension and selectively activate the at least one actuator to achieve the new position.

Additionally or alternatively, the buffer device (107) may include a tension sensor, such as a piezoelectric or other sensor. This sensor is configured to measure the tension of the substrate (106) and dynamically alter the positioning of the rollers (111) to maintain the desired tension on the substrate (106).

The buffer device (107) may also include at least one sensor configured to measure the current use of available substrate storage in the buffer device (107). In certain embodiments, the sensor may be a position sensor configured to provide data corresponding to the position of one or more of the rollers (111-1). The position sensor may include any suitable position sensor or encoder available, as may fit a particular application of the principles described herein. Suitable position sensors may include, but are not limited to, magnetic sensors, optical sensors, electronic sensors, and the like.

The relative amount of available space used in the buffer device (107) may be extrapolated by the data from the sensor. These data may be accessible to control circuitry in the first and second print engines (103, 105, FIG. 1) and monitored by the control circuitry as print operations are performed by the print engines (103, 105, FIG. 1).

For example, if control circuitry in the first print engine (103, FIG. 1) ascertains from the sensor data that the buffer device (107) is full, print operations in the first print engine (103, FIG. 1) may be slowed or stalled until enough of the substrate (106) stored in the buffer device (107) has been consumed by the second print engine (105, FIG. 1) to allow the first print engine (103, FIG. 1) to continue print operations and output more substrate (106) to the buffer device (107). Moreover, if the control circuitry in the second print engine (105, FIG. 1) ascertains from the data that the buffer device (107) is operating at minimum capacity, print operations in the second print engine (105, FIG. 1) may be slowed or stalled until enough of the substrate (106) has been provided by the first print engine (103, FIG. 1) to the buffer device (107) to allow the second print engine (105, FIG. 1) to continue or increase print operations.

In other embodiments, the first and second print engines (103, 105, FIG. 1) may be configured to feed and print to the web substrate (106) at variable velocities. In such embodiments, the amount of storage in the buffer device (107) may be controlled by selectively controlling the respective velocities at which the print engines (103, 105, FIG. 1) operate. For example, if the buffer device (107) is operating at minimum capacity, the velocity at which the first print engine (103, FIG. 1) operates may be increased with respect to the velocity at which the second print engine (105, FIG. 1) operates such that a net flow of substrate (106) into the buffer device (107) is created. Conversely, if the buffer device (107) is operating at a maximum capacity, a net flow of substrate (106) out of the buffer device (107) may be created by causing the second print engine (105, FIG. 1) to operate at a greater velocity than that of the first print engine (105, FIG. 1). In certain embodiments, the respective velocities of the first and second print engines (103, 105, FIG. 1) may be continuously variable to avoid situations in which the buffer device (107) is operating at a maximum or minimum capacity.

Figure 3:
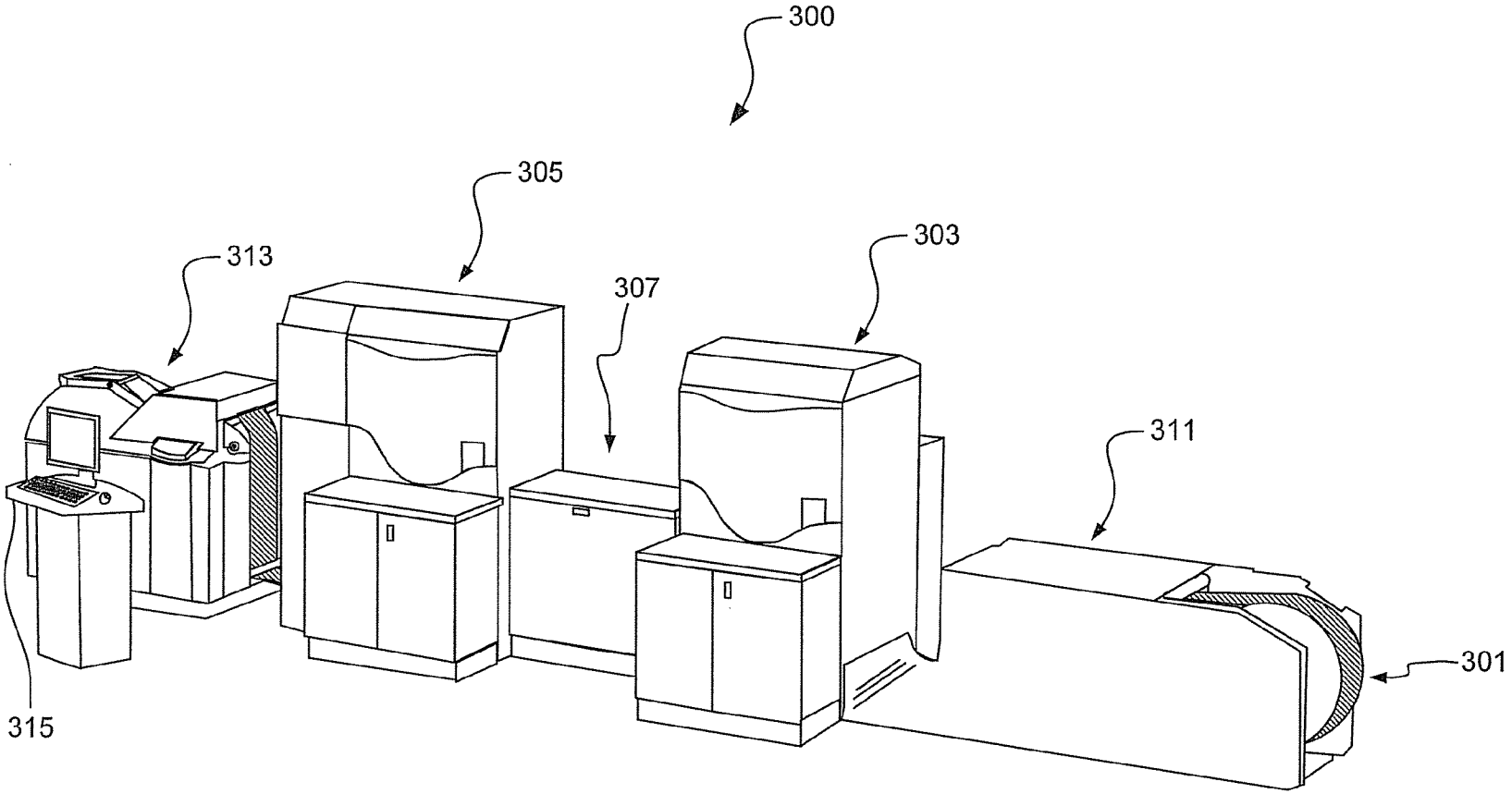
FIG. 3 is a diagram of an illustrative system of printing to a web substrate according to one embodiment of the principles described herein.

Referring now to FIG. 3, an illustrative system (300) for printing to a web substrate (301) is shown. The illustrative system (300) may implement principles described in relation to FIGS. 1-2 above.

The illustrative system (300) may include a first print engine (303), a second print engine (305), and a buffer device (307) as described. The print engines (303, 305) of the present example may be print engines used for large-scale digital printing press systems, such as those used in Hewlett Packard Indigo® printing presses or similar devices.

In the present system (300), an unwinding module (311) may be configured to house a roll of web substrate (301) and feed the substrate (301) to the first print engine (303). The unwinding module (311) may include a roll lift configured to lift the roll of web substrate (301) as the substrate (301) is consumed, thus maintaining a desired alignment with transport components within the unwinding module (311) throughout print operations. The unwinding module (311) may also include a device configured to unwind the roll of web substrate (301) as the substrate (301) is consumed.

The first print engine (303) may be configured to receive the substrate (301) as needed from the unwinding module (311) and print on a first side of the substrate (301). The buffer device (307), as will be described herein, may be configured to store a variable amount of web substrate (301) received from the first print engine and feed the substrate (301) to the second print engine (305) as needed. Additionally, the buffer device (307) may include inverter components configured to flip the substrate (301) over such that a second side of the substrate (301) is facing upward as the substrate (301) is fed to the second print engine (305) in preparation for the second print engine (305) to print to the second side of the substrate (301).

As described above, each of the print engines (303, 305) may be configured to print to the substrate (301) independent of the rate at which the substrate (301) is being consumed by the other of the print engines (303, 305). However, each of the print engines (303, 305) may be communicatively coupled to the buffer device (307) and configured to increase, stall or slow print operations if the buffer device (307) is either too full or too empty to allow print operations to continue.

A finishing module (313) may be configured to receive the substrate (301) from the second print engine (305). The finishing module (313) is configured to perform operations such as cutting the substrate (301) into individual sheets, stacking the sheets, and outputting the sheets to a user.

In certain embodiments, it may be desirable to synchronize printed items on the substrate (301) created by both of the print engines (303, 305). For example, the first print engine (303) may be configured to print the front sides of a plurality of documents with the second print engine (305) being configured to print corresponding back sides to each of the plurality of documents. However, due to nature of the system (300), once the front side of a document has been printed by the first print engine, a portion of substrate (301) corresponding to the document may not reach the second print engine (305) until after passing through the buffer device (307)—at which point the second print engine (305) may have completed a number of additional print cycles.

In order to allow the back side of the document to appear in the print queue of the second print engine (305) precisely as the portion of the substrate (301) corresponding to the front side of the document is fed into the second print engine (305), the first and second print engines (303, 305) may be configured to run one or more null or stall print cycles. In a null cycle, substrate (301) may be advanced through the print engine (303, 305) without any print operations being performed on the substrate (301) by the print engine (303, 305). In a stall cycle, a printing engine (303, 305) pauses operations for a specified amount of time without losing its position on the substrate (301). Moreover, after running a stall cycle, a printing engine (303, 305) may be configured to compensate for deceleration and acceleration in printing operations without wasting substrate (301). Null and stall cycles may be used by the print engines (303, 305) to coordinate print operations by each of the print engines (303, 305) in corresponding portions of the substrate (301). Additionally, stall cycles may be used to delay print operations while the print engines (303, 305) are reconfigured.

These null and stall cycles may be injected into the printer operation queues of the print engines (303, 305) by a software driver configured to correlate operations of the two print engines (303, 305). In some embodiments, the operations of the software driver and/or the print engines (303, 305) may be configured, altered, and/or cancelled on the fly by a user at a workstation (315).

Furthermore, to precisely align corresponding print operations between the two print engines (303, 305), at least one of the print engines (303, 305) may include one or more devices to accurately and precisely measure the amount of substrate (301) that is fed through the print engines (303, 305). In certain embodiments, one or more of the print engines (303, 305) may include optical sensors configured to detect visual indicators (i.e. "eyemarks") that are present on the substrate (301) and/or rollers in the print engines (303, 305) at regular intervals.

In certain embodiments, the first print engine (303) may be configured to print the visual indicators to the web substrate (301) such that the second print engine (305) may detect the visual indicators and align corresponding print operations on the substrate (301) with those of the first print engine (301). In other embodiments, the substrate (301) may have already been printed before being used by the system (300), and therefore visual indicators may be present on the substrate (301) so that both print engines (303, 305) may detect the marks and align corresponding print operations accordingly.

Figure 4:
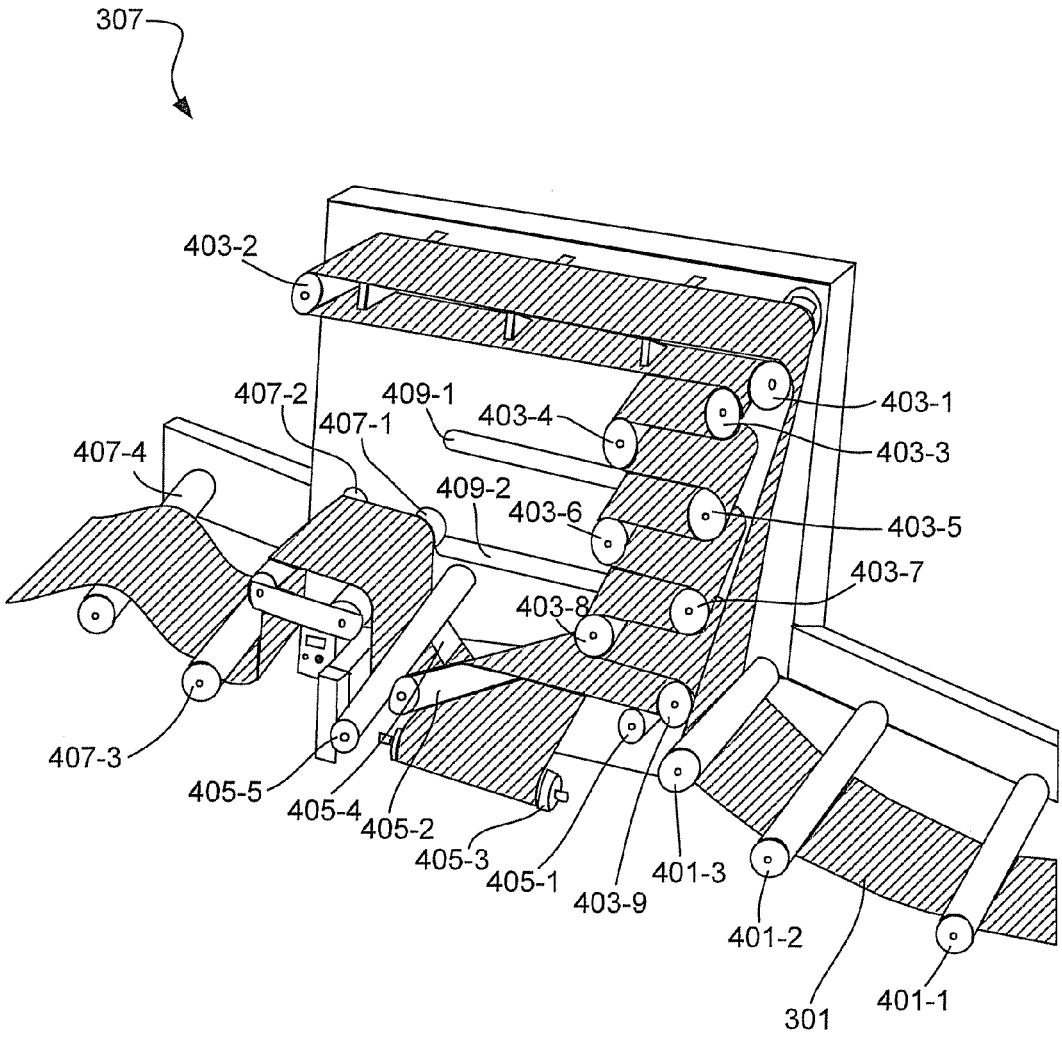
FIG. 4 is a front view of an illustrative buffer device according to one embodiment of the principles described herein.

Referring now to FIG. 4, a partial view is shown of the interior of the buffer device (307) of the illustrative system (300, FIG. 3) described above. The buffer device (307) may include a plurality of rollers (401-1 to 401-3, 403-1 to 403-9, 405-1 to 405-5, and 407-1 to 407-4) configured to transport the substrate (301) along a desired path. At least some of the rollers (401-1 to 401-3, 403-1 to 403-9, 405-1 to 405-5, and 407-1 to 407-4) may be powered by electric motors that are selectively activated by control circuitry in the buffer device (307).

Input web guide rollers (401-1 to 401-3) may be configured to guide the substrate (301) as the substrate (301) is received from the first print engine (303, FIG. 3). Buffer rollers (403-1 to 403-9) may be configured to extend the path of the substrate (301), thus storing the substrate between print operations by the first and second print engines (303, 305, FIG. 3).

At least some of the buffer rollers (403-1 to 403-9) may be configured to move axially along tracks (409-1, 409-2) to increase or decrease the length of the substrate path in the buffer (307) so as to maintain a desired tension in the substrate (301) as the amount of substrate (301) stored in the buffer device (307) changes due to asynchronous print operations in the print engines (303, 305, FIG. 3). The buffer device (307) may include at least one actuator, such as a hydraulic piston, pneumatic actuator, and/or electric motor, configured to move the buffer rollers (403-1 to 403-9) according to the desired positioning. Control circuitry in the buffer device (307) may selectively activate the actuator according to input received from one or more sensors in the buffer device (307) or from the print engines (303, 305, FIG. 3) as discussed above.

Inverter rollers (405-1 to 405-5) may include turn bar rollers (405-2, 405-4) and other rollers (405-1, 405-3, 405-5) configured to flip the substrate (301) over such that a side that was previously facing downward may now be facing upward after passing through the buffer device (307). This may be used to enable duplex printing by the print engines (303, 305, FIG. 3) as explained above.

Output web guide rollers (407-1 to 407-4) may be configured to guide the substrate (301) as the substrate (301) exits the buffer device (307) and is received into the second print engine (305, FIG. 3). The output rollers (407-1 to 407-4) may position the substrate (301) optimally for print operations by the second print engine (305, FIG. 3).

Figure 5:
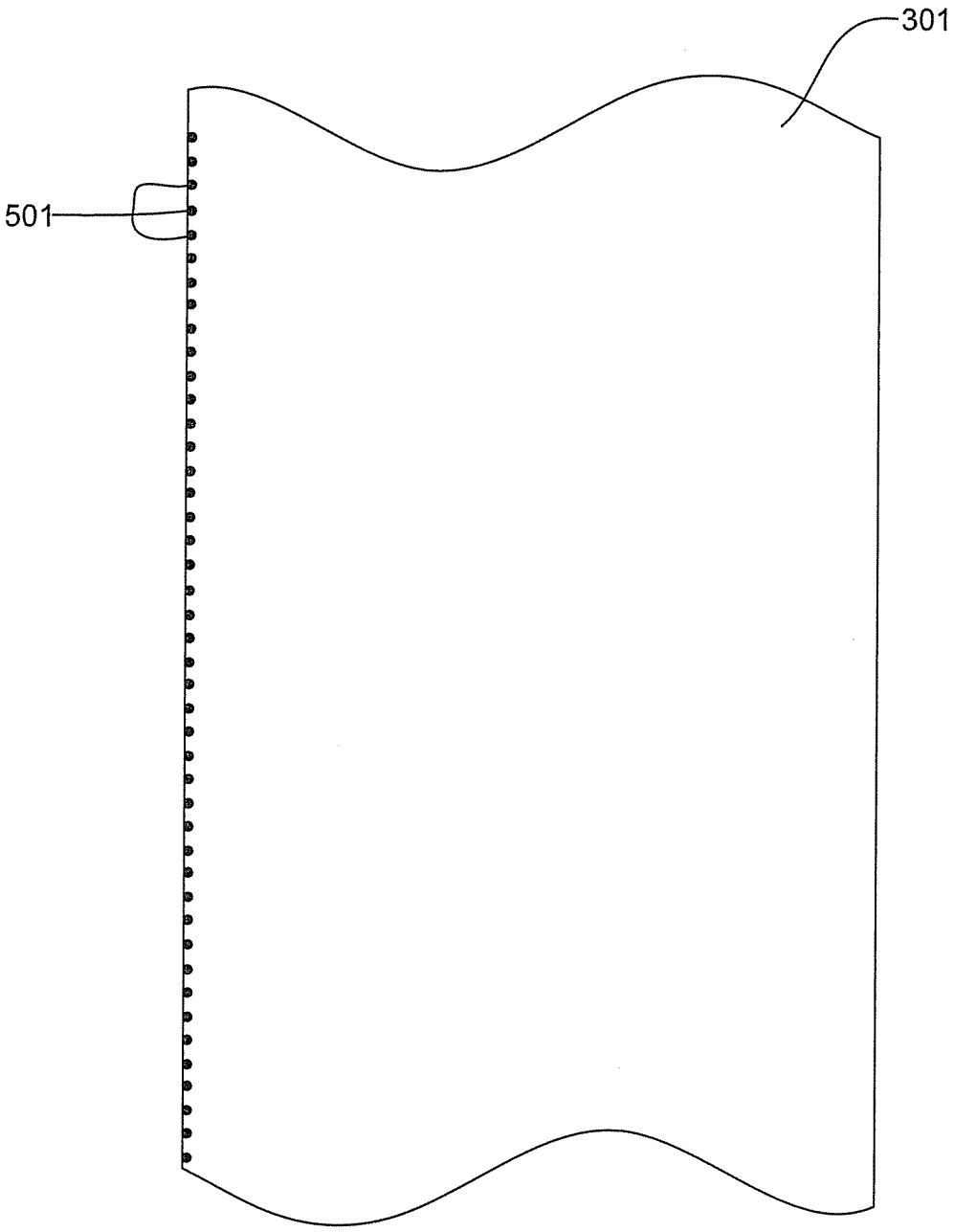
FIG. 5 is a top view of a portion of an illustrative substrate in a system printing to a web substrate according to one embodiment of the principles described herein.

Referring now to FIG. 5, an illustrative portion of web substrate (301) is shown. In the present example, the web substrate (301) includes a plurality of visual indicators (501) that may be detected by the print engines (303, 305, FIG. 3) to precisely measure the amount of substrate (301) that is fed through the print engines (303, 305, FIG. 3). This measurement may enable the print engines (303, 305, FIG. 3) to precisely align corresponding print operations. In certain embodiments, the visual indicators (501) may be trimmed from the substrate (301) by the finishing module (313, FIG. 3). In other embodiments, the visual indicators (501) may be disposed on any suitable location on the substrate, (301) of any suitable appearance, and of any suitable interval as may fit a particular application of the principles described herein.

Figure 6:
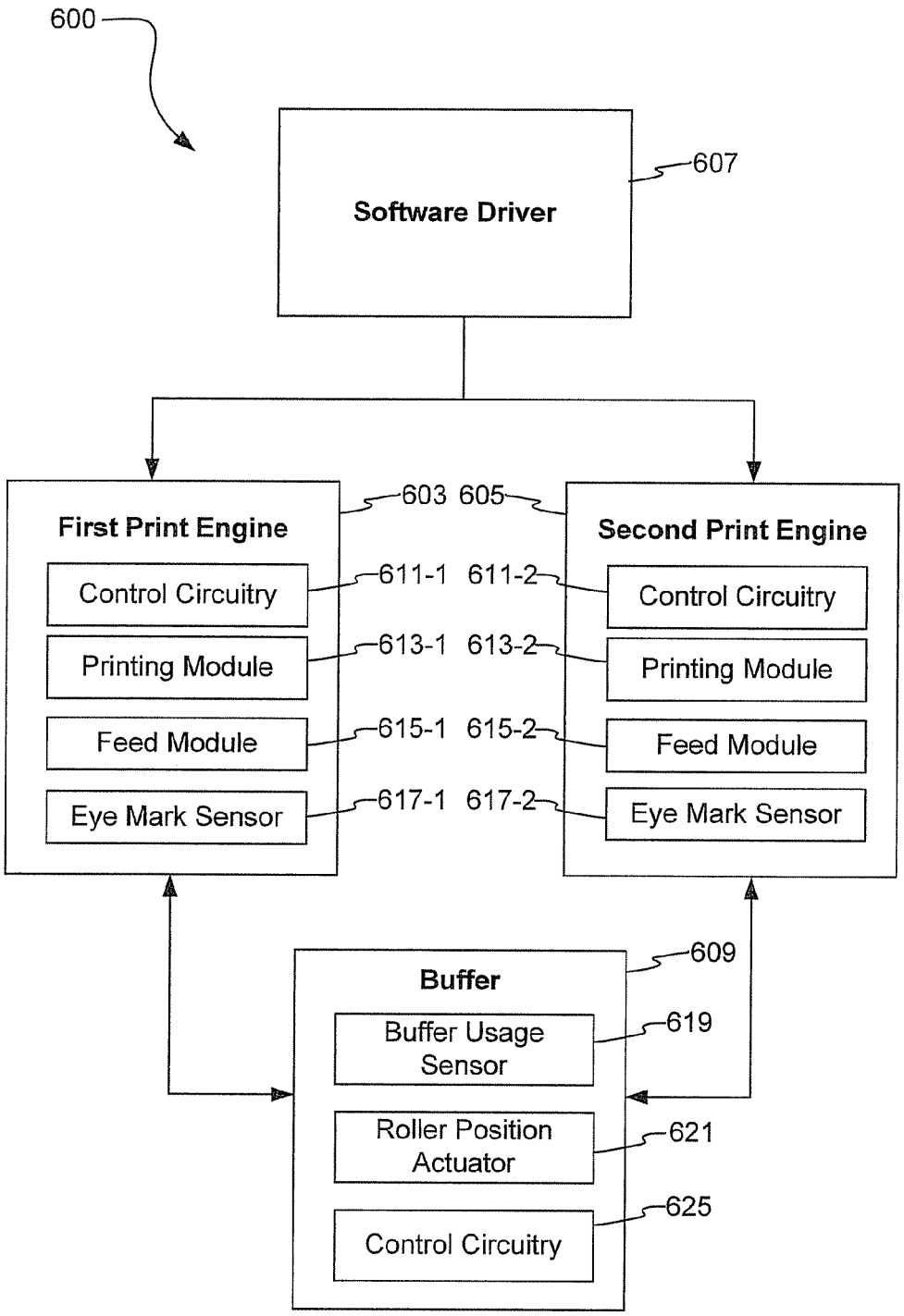
FIG. 6 is a block diagram of illustrative electronic modules in a system of printing to a web substrate according to one embodiment of the principles described herein.

Referring now to FIG. 6, a block diagram of components in an illustrative system (600) for printing to a web substrate is shown. The system (600) may include first and second print engines (603, 605, respectively) configured to operate in tandem to print to the web substrate. A software driver (607) may provide the first and second print engines (603, 605) with data corresponding to the desired images and text to be printed on the substrate in a format readable by the print engines (603, 605). The data provided by the software driver (607) may include print operations data, feed data, and any other data needed by the print engines (603, 605) to print a desired document, according to a particular application.

The software driver (607) may be configured to translate data corresponding to a desired document to be printed to machine-level data for each of the print engines (603, 605) to interpret. The software driver (607) may be configured to coordinate the operations of the first and second print engines (603, 605) to align print operations in the print engines (603, 605) that correspond to each other with a desired portion of substrate.

A buffer device may be disposed intermediate the first and second print engines (603, 605). The buffer may be configured to store a variable amount of web substrate received from the first print engine (603) and feed the substrate to the second print engine (605).

Each of the print engines (603, 605) may include control circuitry (611-1, 611-2) to control operations of a printing module (613-1, 613-2) and a feed module (615-1, 615-2). The printing modules (613-1, 613-2) may be configured to perform the actual print operations on the substrate, while the feed modules (615-1, 615-2) may be configured to transport the substrate through the print engines (603, 605). The control circuitry (611-1, 611-2) in at least one of the print engines (603, 605) may receive data from an eye mark sensor (617-1, 617-2) that detects the presence of visual indicators on the substrate. By tracking the visual indicators on the substrate, corresponding print operations may be coordinated between the print engines (603, 605) consistent with principles described herein.

Additionally, the control circuitry (611-1, 611-2) in each of the print engines (603, 605) may be configured to receive information from a buffer usage sensor (619) in the buffer device (609). In certain embodiments, the buffer usage sensor (619) may be a position sensor configured to detect the position of dynamically translatable rollers in the buffer device (609).

The buffer usage sensor (619) may provide data to the control circuitry (611-1, 611-2) corresponding to the amount of substrate being stored in the buffer device (609) in the context of the capacity of the buffer device (609). These data may be used by the first print engine (603) to stall print operations if the buffer device (609) does not have the capacity to receive additional substrate from the first print engine (603). Additionally, the data may be used by the second print engine (605) to stall print operations if the buffer device (609) does not have a sufficient amount of substrate stored to provide to the second print engine (605) for its print operations.

The buffer device (609) may also include a roller position actuator (621), such as a hydraulic actuator and/or an electric motor. This actuator (621) is configured to dynamically translate rollers in the buffer device (609) as the amount of substrate stored in the buffer device (609) varies in order to maintain the substrate at a constant desired tension.

One or more roller drives (623) in the buffer device (609), such as electric motors, may be configured to rotate one or more of a plurality of rollers in the buffer device (609) to feed the substrate through the buffer device (609). Control circuitry (625) within the buffer device (609) may be configured to control operations of the buffer device (609), such as by selectively activating the roller position actuator(s) (621) and the roller drive(s) (623). Additionally, the control circuitry (625) of the buffer device (609) may communicate with the control circuitry (611-1, 611-2) of the print engines (603, 605) to provide buffer usage data extrapolated from the buffer usage sensor (619) to the print engines (603, 605).

Figure 7:
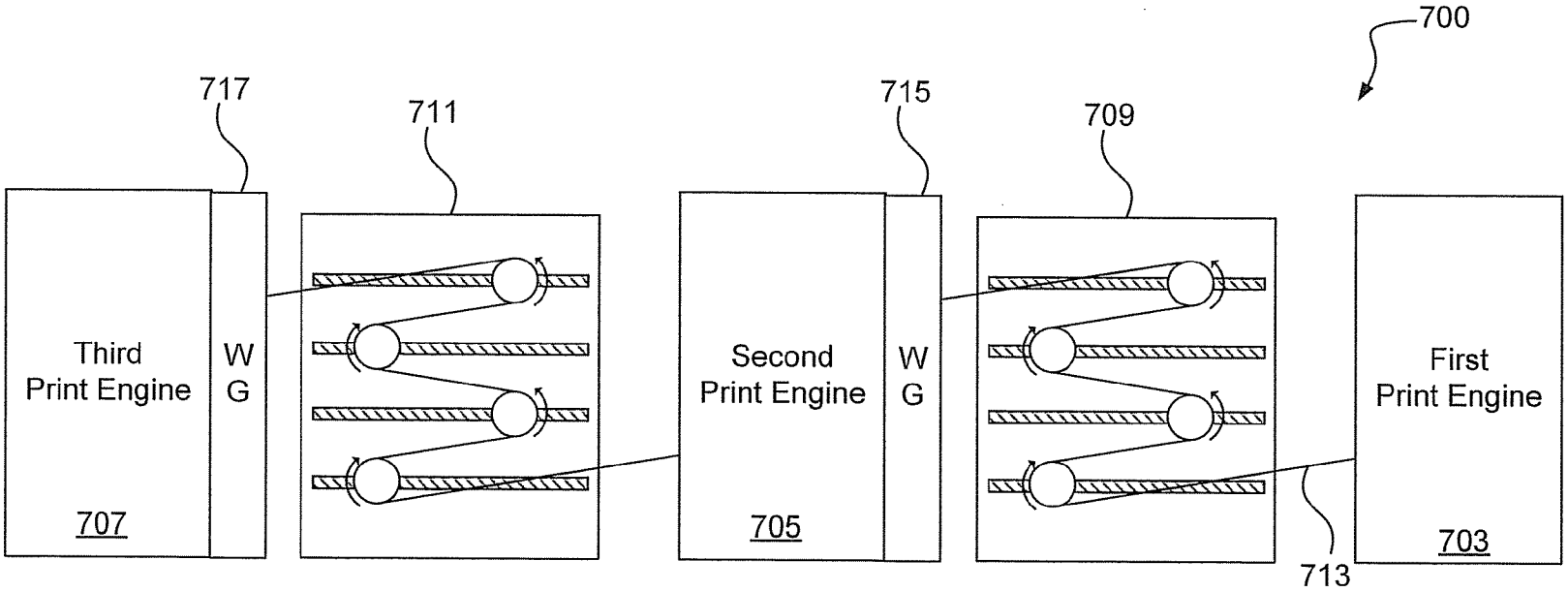
FIG. 7 is a diagram of an illustrative system of printing to a web substrate according to one embodiment of the principles described herein.

Referring now to FIG. 7, another embodiment of an illustrative system (700) of printing to a web substrate is shown. In this embodiment, the system (700) may include first, second and third print engines (703, 705, 707) configured to operate in tandem at rates independent of each other. A first buffer device (709) may be disposed between the first print engine (703) and the second print engine (705), and a second buffer device (711) may be disposed between the second print engine (705) and the third print engine (707).

First and second web guides (715, 717) may be disposed between the first and second buffer devices (709, 711) and the second and third print engines (705, 707), respectively. The web guides may be configured to position the substrate (713) such that the second and third print engines (705, 707), respectively, may receive the substrate (713) in a proper orientation. The web guides (715, 717) may include powered rollers in accordance with principles described herein.

The print engines (703, 705, 707) and the buffer devices (709, 711) may operate and interact with each other in accordance with principles described herein. However, the operations of all three print engines (703, 705, 707) may be coordinated to produce the desired images and/or text on the web substrate (713).

The second print engine (705) may be in communication with both the first buffer device (709) and the second buffer device (711). Thus, control circuitry in the second print engine (705) may verify that substrate is available from the first buffer device (709) and that the second buffer device (711) has the capacity to store additional substrate prior to performing print operations.

In certain embodiments, any number of print engines (703, 705, 707) may be used together with buffer devices (709, 711) to print to a web substrate, as may fit a particular application of the principles described herein.

Illustrative Method

Figure 8:
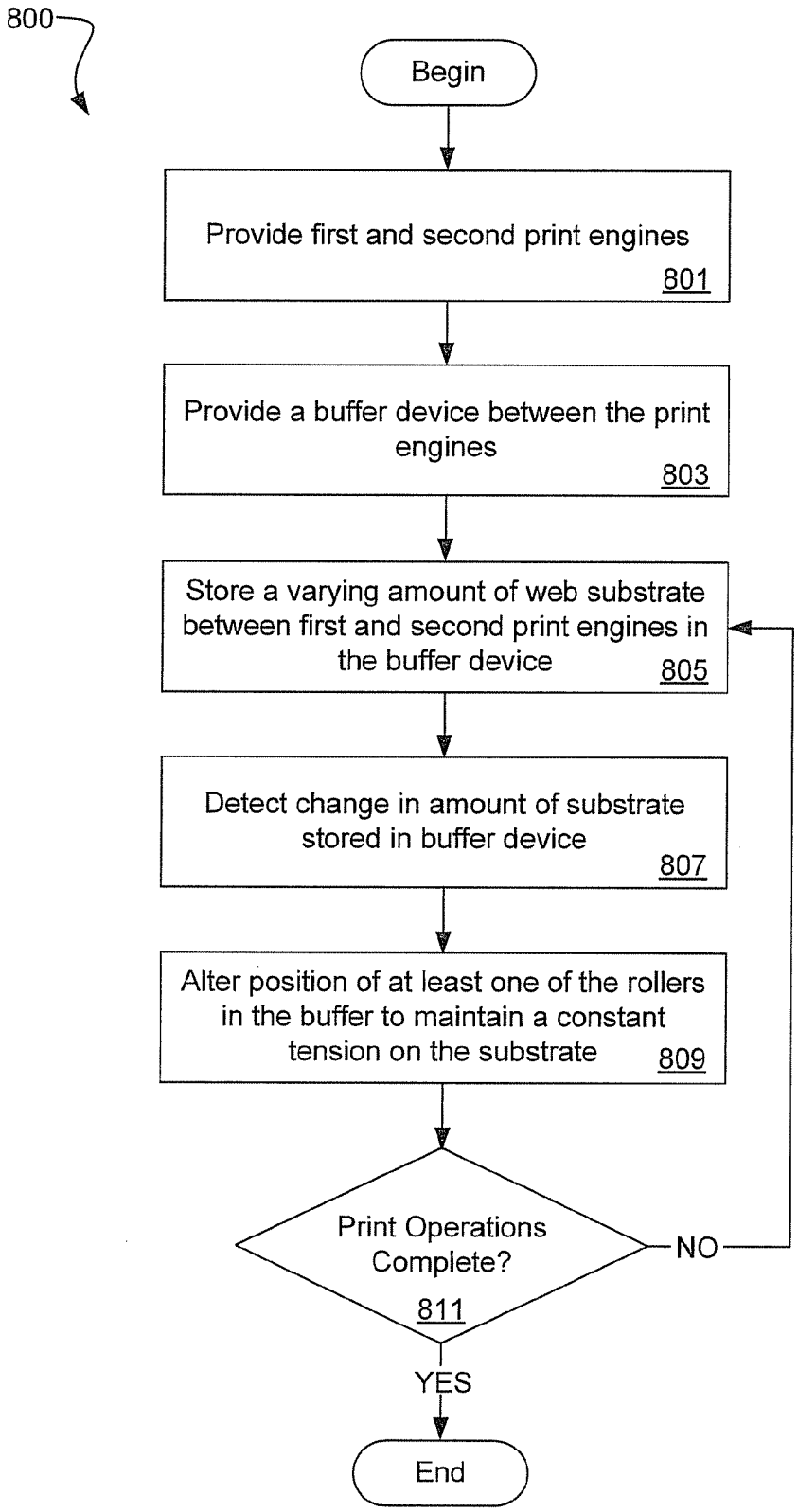
FIG. 8 is a block diagram of an illustrative method of web-fed printing according to one embodiment of the principles described herein.

Referring now to FIG. 8, an illustrative method (800) of printing to a web substrate is shown. In the method (800), first and second print engines may be provided (step 801) and a buffer device may be provided (step 803) between the print engines. The buffer device may have a plurality of rollers to store web substrate used by the print engines.

A varying amount of web substrate may be stored (step 805) between the first and second print engines in the buffer device. For example, the web substrate may be received into the buffer device after the first print engine has printed to the web substrate. The buffer device may then feed the stored web substrate to the second print engine for print operations.

A change in the amount of web substrate stored in the buffer device may then be detected (step 807). This may be done using a sensor in the buffer device and/or by continuously monitoring the amount of substrate output from the first print engine to the buffer device and the amount of substrate received into the second print engine from the buffer device. Moreover, in certain embodiments, data may be continuously provided to the print engines corresponding to the amount of substrate stored in the buffer device.

After the change is detected (step 807), the position of at least one of the rollers in the buffer device may be altered (step 809) to maintain a constant tension on the substrate. For example, if substrate is received into the buffer device from the first print engine, one or more rollers may be moved to create a longer substrate path through the buffer device to maintain the substrate at a desired tension.

Conversely, if substrate is removed from the buffer device by the second print engine, one or more rollers may be moved to create a shorter substrate path through the buffer device to maintain the substrate at the desired tension. The change in the position of the one or more rollers may be accomplished by selectively activating an actuator in the buffer device.

In certain embodiments, the substrate may be fed through the buffer device as needed by selectively driving at least one of the rollers with an electric motor or other source of mechanical energy.

Once it is determined (decision 811) that print operations have been completed in the print engines, the process may end. Otherwise, the steps of storing (step 805) a varying amount of web substrate between the first and second print engines in the buffer device, detecting (step 807) a change in the amount of substrate stored in the buffer device, and altering (step 809) the position of at least one of the rollers may be repeated as print operations continue in the first and second print engines.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printing device (100, 101), comprising:

a first print engine (103, 303, 603, 703);

a second print engine (105, 305, 605, 705); and a buffer device (107, 307, 609, 709, 711) disposed between said first (103, 303, 603, 703) and second print engines (105, 305, 605, 705), said buffer device having a plurality of movable rollers adjacent a plurality of fixed rollers, wherein each of said plurality of movable rollers are rotated axially through channels by electric motors each selectively activated by control circuitry in the buffer device to increase and decrease a length of substrate path;

wherein said buffer device (107, 307, 609, 709, 711) is configured to store a variable amount of web substrate (106, 301, 713) received from said first print engine (103, 303, 603, 703) and feed said substrate (106, 301, 713) to said second print engine (105, 305, 605, 705).

2. The printing device (100, 101) of claim 1, wherein each of said first (103, 303, 603, 703) and second print engines (105, 305, 605, 705) is configured to print to said web substrate (106, 301, 713) independent of a speed or print phase of the other of said first (103, 303, 603, 703) and second print engines (105, 305, 605, 705).

3. The printing device (100, 101) of claim 1, wherein said buffer (107, 307, 609, 709, 711) is further configured to maintain said variable amount of web substrate (106, 301, 713) at a substantially constant tension.

4. The printing device (100, 101) of claim 1, wherein said first print engine (103, 303, 603, 703) includes control circuitry to print to a first side of said web substrate (106, 301, 713) and said second print engine (105, 305, 605, 705) includes control circuitry to print to a second side of said web substrate (106, 301, 713).

5. The printing device (100, 101) of claim 4, wherein said buffer (107, 307, 609, 709, 711) comprises an inverter device (113) configured to flip said web substrate (106, 301, 713) for said second print engine (105, 305, 605, 705) to print to said second side.

6. The printing device (100, 101) of claim 1, further comprising a web guide (109, 715, 717) disposed between said buffer device (107, 307, 609, 709, 711) and said second print engine (105, 305, 605, 705), wherein said web guide (109, 715, 717) is configured to position said web substrate (106, 301 713) at an input of said second print engine (105, 305, 605, 705).

7. The printing device (100, 101) of claim 1, further comprising:

a sensor (619) configured to provide data to each of said print engines (103, 105, 303, 305, 603, 605, 703, 705, 707), wherein said data corresponds to an amount of web substrate (109, 715, 717) stored in said buffer (107, 307, 609, 709, 711);

circuitry (611-1) in said first print engine (103, 303, 603, 703) to receive said data and stall print operations in said first print engine (103, 303, 603, 703) if said data indicates that said buffer (107, 307, 609, 709, 711) is full; and circuitry (611-2) in said second print engine (105, 305, 605, 705) to receive said data and stall print operations in said second print engine (105, 305, 605, 705) if said data indicates that said buffer (107, 307, 609, 709, 711) comprises less substrate (106, 301, 713) than an amount needed to continue print operations.

8. The printing device (100, 101) of claim 1, wherein each of said print engines (103, 105, 303, 305, 603, 605, 703, 705, 707) includes control circuitry to selectively perform a null printing cycle and a stalled printing cycle to synchronize print operations between said print engines (103, 105, 303, 305, 603, 605, 703, 705, 707).

9. The printing device (100, 101) of claim 1, wherein at least one of said print engines (103, 105, 303, 305, 603, 605, 703, 705, 707) comprises a sensor (617-1, 617-2) detecting visual alignment indicators (501) on said web substrate (106, 301, 713).

10. A system (300, 600, 700) of printing to a web substrate (106, 301, 713), comprising:

a first print engine (103, 303, 603, 703) coupled to a web of substrate (106, 301, 713), said first print engine (103, 303, 603, 703) being configured to print to a first side of said substrate (106, 301, 713);

a second print engine (105, 305, 605, 705) configured to print to a second side of said substrate (106, 301, 713);

a buffer device (107, 307, 609, 709, 711) movable axially in tracks formed within walls adjacent the buffer device, the buffer device having a plurality of rollers and individual control motors configured to store a variable amount of said substrate (106, 301, 713) received from said first print engine (103, 303, 603, 703) at a substantially constant tension and feed said substrate (106, 301, 713) to said second print engine (105, 305, 605, 705); and a sensor (619) configured to provide each of said first (103, 303, 603, 703) and second print engines (105, 305, 605, 705) with data corresponding to an amount of substrate (106, 301, 713) stored by said buffer device (107, 307, 609, 709, 711).

11. The system (300, 600, 700) of claim 10, wherein each of said first (103, 303, 603, 703) and second print engines (105, 305, 605, 705) includes control circuitry to print to said web substrate (106, 301, 713) independent of a speed or print phase of the other of said first (103, 303, 603, 703) and second print engines (105, 305, 605, 705).

12. The system (300, 600, 700) of claim 10, wherein said buffer (107, 307, 609, 709, 711) further comprises:

a plurality of rollers (111-1, 111-2, 111-3, 111-4, 401-1, 401-2, 401-3, 403-1, 403-2, 403-3, 403-4, 403-5, 403-6, 403-7, 403-8, 403-9, 405-1, 405-2, 405-3, 405-4, 405-5, 407-1, 407-2, 407-3, 407-4); and an electronic actuator (621) selectively altering a distance between said rollers (111-1, 111-2, 111-3, 111-4, 401-1, 401-2, 401-3, 403-1, 403-2, 403-3, 403-4, 403-5, 403-6, 403-7, 403-8, 403-9, 405-1, 405-2, 405-3, 405-4, 405-5, 407-1, 407-2, 407-3, 407-4).

13. The system (300, 600, 700) of claim 12, wherein said buffer system (107, 307, 609, 709, 711) further comprising:

a tension sensor detecting tension of said substrate (106, 301, 713) between said rollers (111-1, 111-2, 111-3, 111-4, 401-1, 401-2, 401-3, 403-1, 403-2, 403-3, 403-4, 403-5, 403-6, 403-7, 403-8, 403-9, 405-1, 405-2, 405-3, 405-4, 405-5, 407-1, 407-2, 407-3, 407-4); and control circuitry (625) coupled to said tension sensor to selectively activate said actuator (621) to maintain said constant tension.

14. The system (300, 600, 700) of claim 10, wherein said buffer (107, 307, 609, 709, 711) comprises an inverter device (113) flipping said substrate (106, 301, 713) for said second print engine (105, 305, 605, 705) to print to said second side.

15. The printing device (300, 600, 700) of claim 10, further comprising:

circuitry (611-1) in said first print engine (103, 303, 603, 703) configured to stall print operations in said first print engine (103, 303, 603, 703) if said data indicates that said buffer (107, 307, 609, 709, 711) is full; and circuitry (611-2) in said second print engine (105, 305, 605, 705), the circuitry stalling print operations in said second print engine (105, 305, 605, 705) if said data indicates that said buffer (107, 307, 609, 709, 711) comprises less substrate (106, 301, 713) than an amount needed to continue print operations.

16. The printing device (300, 600, 700) of claim 10, wherein each of said print engines (103, 105, 303, 305, 603, 605, 703, 705, 707) includes control circuitry to selectively perform both of a null printing cycle and a stalled printing cycle to synchronize print operations between said print engines (103, 105, 303, 305, 603, 605, 703, 705, 707).

17. The printing device (300, 600, 700) of claim 10, wherein at least one of said print engines (103, 105, 303, 305, 603, 605, 703, 705, 707) comprises a sensor (617-1, 617-2) to detect visual alignment indicators (501) on said web substrate (106, 301, 713).

18. A method of printing to a web substrate (106, 301, 713), said method comprising:

storing a varying amount of web substrate (106, 301, 713) between first (103, 303, 603, 703) and second print engines (105, 305, 605, 705) in a buffer device (107, 307, 609, 709, 711) having a plurality of rollers (111-1, 111-2, 111-3, 111-4, 401-1, 401-2, 401-3, 403-1, 403-2, 403-3, 403-4, 403-5, 403-6, 403-7, 403-8, 403-9, 405-1, 405-2, 405-3, 405-4, 405-5, 407-1, 407-2, 407-3, 407-4), at least some of the rollers rotating axially within tracks formed in walls adjacent the rollers; and altering a position of at least one of said rollers (111-1, 111-2, 111-3, 111-4, 401-1, 401-2, 401-3, 403-1, 403-2, 403-3, 403-4, 403-5, 403-6, 403-7, 403-8, 403-9, 405-1, 405-2, 405-3, 405-4, 405-5, 407-1, 407-2, 407-3, 407-4) by individual motors each controlling ones of said rollers as said amount of substrate (106, 301, 713) varies to maintain a constant tension on said substrate (106, 301, 713).

19. The method of claim 18, further comprising selectively activating an electronic actuator (621) to alter said position of said at least one roller (111-1, 111-2, 111-3, 111-4, 401-1, 401-2, 401-3, 403-1, 403-2, 403-3, 403-4, 403-5, 403-6, 403-7, 403-8, 403-9, 405-1, 405-2, 405-3, 405-4, 405-5, 407-1, 407-2, 407-3, 407-4).

20. The method of claim 18, further comprising providing data corresponding to said varying amount of web substrate (106, 301, 713) stored by said buffer (107, 307, 609, 709, 711) to said first (103, 303, 603, 703) and second print engines (105, 305, 605, 705).

21. The method of claim 18, further comprising printing to a first side of said web substrate (106, 301, 713) and printing to a second side of said web substrate (106, 301, 713).

22. The method of claim 18, further comprising detecting visual alignment indicators (501) on said web substrate (106, 301, 713).

23. The method of claim 18, further comprising selectively performing a null printing cycle and a stalled printing cycle to synchronize print operations between said print engines (103, 105, 303, 305, 603, 605, 703, 705, 707).

24. The method of claim 23, wherein:

in said null printing cycle, said web substrate (106, 301, 713) is advanced through said first (103, 303, 603, 703) and second print engines (105, 305, 605, 705) without any print operations being performed on the web substrate (106, 301, 713) by said first (103, 303, 603, 703) and second print engines (105, 305, 605, 705);

in said stalled printing cycle, said first (103, 303, 603, 703) and second print engines (105, 305, 605, 705) pause operations for a specified amount of time without losing position on said web substrate (106, 301, 713), and after running said stalled printing cycle, said first (103, 303, 603, 703) and second print engines (105, 305, 605, 705) compensate for deceleration and acceleration in printing operations without wasting said web substrate (106, 301, 713).

25. The method of claim 23, wherein said stalled printing cycle is invoked to delay print operations while the said first (103, 303, 603, 703) and second print engines (105, 305, 605, 705) are reconfigured.

* * * * *

UNITED STATES PATENT AND TRADEMARK OFFICE

CERTIFICATE OF CORRECTION

PATENT NO. : 8,935,980 B2
APPLICATION NO. : 12/918305
DATED : January 20, 2015
INVENTOR(S) : Benji Ruhm et al.

It is certified that error appears in the above-identified patent and that said Letters Patent is hereby corrected as shown below:

In the claims

In column 11, line 33, in Claim 6, delete "301" and insert -- 301, --, therefor.

In column 12, line 50, in Claim 15, delete "printing device" and insert -- system --, therefor.

In column 12, line 62, in Claim 16, delete "printing device" and insert -- system --, therefor.

In column 13, line 1, in Claim 17, delete "printing device" and insert -- system --, therefor.

Signed and Sealed this
Twenty-eighth Day of June, 2016

Michelle K. Lee

Michelle K. Lee
*Director of the United States Patent and Trademark Office*